US011238688B2

(12) United States Patent
Bernhardt et al.

(10) Patent No.: US 11,238,688 B2
(45) Date of Patent: Feb. 1, 2022

(54) INTELLIGENT CASH DRAWER UNIT OR CASH REGISTER AND METHODS OF OPERATION THEREFOR

(71) Applicant: Tellermate Limited, Newport (GB)

(72) Inventors: Mark Bernhardt, Hampshire (GB); Gerard Nicholas Schoen, South Wales (GB); Gareth Ross Jones, South Wales (GB); Justin Ray, South Wales (GB)

(73) Assignee: Tellermate Limited, Newport (GB)

( * ) Notice: Subject to any disclaimer, the term of this patent is extended or adjusted under 35 U.S.C. 154(b) by 0 days.

(21) Appl. No.: 16/332,764

(22) PCT Filed: Sep. 13, 2017

(86) PCT No.: PCT/GB2017/052682
§ 371 (c)(1),
(2) Date: Mar. 12, 2019

(87) PCT Pub. No.: WO2018/051073
PCT Pub. Date: Mar. 22, 2018

(65) Prior Publication Data

US 2019/0221066 A1 Jul. 18, 2019

(30) Foreign Application Priority Data

Sep. 13, 2016 (GB) ..... 1615490

(51) Int. Cl.
*G07D 11/23* (2019.01)
*G07G 1/00* (2006.01)
(Continued)

(52) U.S. Cl.
CPC ..... *G07D 11/23* (2019.01); *G07D 11/12* (2019.01); *G07D 11/235* (2019.01); *G07D 11/34* (2019.01);
(Continued)

(58) Field of Classification Search
CPC ..... G07D 11/23; G07D 11/34; G07D 11/12; G07D 11/235; G07G 1/0009; G07G 1/0027; G07G 1/12
See application file for complete search history.

(56) References Cited

U.S. PATENT DOCUMENTS 4,495,627 A 1/1985 Nishimura
4,512,428 A 4/1985 Bullivant
(Continued)

FOREIGN PATENT DOCUMENTS

EP 0281106 A2 9/1988
EP 724242 A2 7/1996
(Continued)

OTHER PUBLICATIONS

Search Report and Application No. EPO724242, dated Jul. 31, 1996.
(Continued)

*Primary Examiner* — Sonji N Johnson
(74) *Attorney, Agent, or Firm* — Leydig, Voit & Mayer, Ltd.; Gerald T. Gray

(57) ABSTRACT

An intelligent cash drawer unit or cash register is operable to process signals from load cells beneath note/coin cups when the drawer is open. It then determines the weight/value of cash in the cups, in order to either (a) detect an accurate weight in a cup comprising a poorly placed note, or (b) allow a float to be added, or a lift to be made, stepwise, whilst the drawer remains open. An intelligent cash drawer unit or cash register is also described which can detect a poorly placed note, by either (a) comparing signals from the load cells when the drawer is open, and when the drawer is closed or (b) monitoring stable readings, over a predetermined period when the drawer is closed and comparing the monitored values and where the apparent weight determined by the
(Continued)

transducer appears to reduce by more than a predetermined amount, determining that a note is poorly placed.

30 Claims, 6 Drawing Sheets

(51) Int. Cl.
*G07G 1/12* (2006.01)
*G07D 11/235* (2019.01)
*G07D 11/34* (2019.01)
*G07D 11/12* (2019.01)

(52) U.S. Cl.
CPC ..... *G07G 1/0009* (2013.01); *G07G 1/0027* (2013.01); *G07G 1/12* (2013.01)

(56) References Cited

U.S. PATENT DOCUMENTS

| | | | | |
|---|---|---|---|---|
| 4,522,275 | A | 6/1985 | Anderson | |
| 2009/0236431 | A1 | 9/2009 | Benigno et al. | |
| 2011/0172960 | A1* | 7/2011 | St.George | G07G 1/14 702/179 |
| 2015/0034398 | A1 | 2/2015 | Charij | |
| 2019/0035198 | A1* | 1/2019 | Nakashima | G07D 9/00 |

FOREIGN PATENT DOCUMENTS

| | | | |
|---|---|---|---|
| FR | 2586840 | A1 | 9/1985 |
| GB | 2269088 | A | 2/1994 |
| GB | 2407172 | A | 4/2005 |
| GB | 2410363 | A | 7/2005 |

OTHER PUBLICATIONS

Search Report and Application No. GB1714697.8, dated Jun. 13, 2018.
Search Report and Application No. GB1714691.1, dated Feb. 12, 2018.
Search Report and Application No. GB1714693.7, dated Feb. 12, 2018.
Search Report and Application No. GB1615490.8, dated May 26, 2017.
Search Report and Written Opinion in Application No. PCT/GB2017/052682, dated Apr. 5, 2018.

* cited by examiner

INTELLIGENT CASH DRAWER UNIT OR CASH REGISTER AND METHODS OF OPERATION THEREFOR

TECHNICAL FIELD OF THE INVENTION

The present invention relates to intelligent cash drawer units or cash registers and methods of their operation. In particular it relates to methods of identifying poorly placed notes, methods of weighing the contents of cash cups with notes poorly placed therein, and methods of allowing a float to be introduced into, or a lift to be made from an intelligent cash drawer unit. The invention relates especially, although not exclusively to a cash drawer for an intelligent cash drawer unit for use with a separate Electronic Point Of Sale (EPOS) device. The cash drawer may also be for a cash register and in either case is most suitably, but not exclusively a flip-top cash drawer.

BACKGROUND TO THE INVENTION

An intelligent cash drawer unit is a cash drawer unit which contains coins and notes in compartments called cups (obviously tokens, vouchers, or the like could also be contained in the cups, but generally speaking they are used for cash, hence the expression "cash drawer unit"). Unlike a conventional cash drawer, the individual cups are augmented with technology that allows them to be weighed. A transducer underneath each cup reads out a continuous analogue signal that represents the weight of the cup and its contents. This analogue signal is digitized and passed to a signal processor which can compute the weight of the cash contained in the cup. By dividing the weight of the contents of the cup by the known weight of a single coin or note of the appropriate denomination the quantity of notes or coins is computed.

A specific example of such a transducer is a 'load-cell' which changes its electrical resistance in response to the amount of weight placed upon it.

Although digital weight signals relating to each cup are continuously available they may contain transients due to mechanical shocks to the system, such as when new cash is put into a cup, or during opening or closing of the drawer. During these transient periods the readings from the weight transducer may not accurately represent the weight of the cash in the drawer. Such readings are referred to as unstable. Readings from periods of instability are not used to measure the weight of the cash in the cup.

In consequence, intelligent cash drawer units monitor whether the drawer is open or closed and only weigh the cups when the drawer is closed, or ignore readings when the drawer is open.

Methods for determining when a reading has become stable (e.g. by reviewing a number of consecutive readings over a predetermined period and checking they are within a predetermined margin of each other) are also known in the art.

Intelligent cash drawers may be provided as separate cash drawer units with sliding cash drawers or with flip top lids which reveal the cash drawer, for use with associated EPOS units, or can be integrated into cash registers.

An object of the invention is to provide an improved cash drawer.

SUMMARY OF THE INVENTION

According to a first aspect of the invention there is provided an intelligent cash drawer unit or cash register having an openable cash drawer comprising a plurality of cups supported on a plurality of transducers operable to weigh the cups, a signal processor operable to process signals received from the transducers to determine the value of cash in the cups, and a sensor operable to detect whether the drawer is open or closed; characterised in that the signal processor is operable to process signals from the transducers when the sensor detects that the drawer is open, and to determine the weight of cash in the cups when open, in order to either (a) detect an accurate weight in a cup comprising poorly placed cash, or (b) allow a float to be added, or a lift to be made, stepwise, whilst the cash drawer remains open.

The poorly placed cash may be a poorly placed note, for example a note which sticks up from the cup and touches another part of the intelligent cash drawer unit, for example a lid.

The present invention goes against the conventional wisdom (that readings should be taken when the drawer is closed), in order to overcome two problems that affect conventional intelligent cash drawer units or cash registers:

(a) If an item of cash is poorly placed in a cup, it can interact with other parts of the drawer unit to present an incorrect reading—typically, a note in a vertical stack (i.e. a stack of notes arranged with their planes in the substantially vertical axis) may not be inserted fully into the cup and may stick out and press against the top of the cash drawer unit (e.g. the lid of a flip-top cash drawer unit, or the top of the casing of a sliding cash drawer unit) thus giving an incorrect (overly heavy) reading. If the detection is made when the drawer is open, the note will not be bearing on the top of the cash drawer unit, so the correct result can be obtained.

(b) When a lift is made from a cash drawer, if too much cash is taken at once, the drawer cannot calculate with accuracy, how much has been taken (and mutatis mutandis for a float). For example, the weights of English £5 notes are known to vary to the extent that when any more than 10 are taken (or added), and when the accuracy of the transducers is taken into account, there can be a 0.1% chance that the number of notes determined to have been taken (or added) is incorrect (i.e. it could be one more or one less). As those skilled in the art will appreciate, variance in weight between notes is not an issue when they are taken or added in small batches, because the previous weight is known, so even with more than (e.g.) 10 notes in a cup, if they have been added individually or in small batches of e.g. 2-5, there is a very high likelihood that the correct total is known. Weighing whilst the drawer is open allows small batches to be taken out or added stepwise without having to close and reopen the drawer after each addition/removal, substantially increasing the speed of accurately adding a float or making a lift. Indeed, in prior art systems, where too many notes (or coins) are added at once, it can be necessary to completely empty and refill the drawer, a few coins/notes at a time, opening and closing the drawer each time.

The expression "float" in this specification is intended to be understood in a broad term, covering providing cash to an empty drawer for example at the start of a day's trading, or a change of shift, and also to cover replenishing cash at any stage. Essentially, to float is to add cash (not as part of a transaction) and to lift is to remove it (again not as part of a transaction).

In practice, it is rare for too much currency to be introduced to a cash drawer, as a float normally does not require large numbers of any particular denomination. However, after a busy period of trading, it is not unusual for a large number of notes (or coins) to be lifted from a drawer and users are frequently unaware of the reduction in accuracy of the contents registered by the drawer caused by this.

The intelligent cash drawer unit or cash register may comprise a (optionally further) sensor operable to detect when the drawer is fully open.

The intelligent cash drawer unit or cash register may comprise memory which may be operable to store readings.

The signal processor be operable to detect stable readings whilst the drawer is open (including opening/closing), to optionally reject readings that are determined to be unstable, and to store one or more stable readings in the memory. Determination of which readings are stable may be carried out by known algorithms.

The signal processor may be operable to determine when the drawer is opening or closing, based on signals from the sensor detecting when the drawer opens/closes and when it is fully open, or estimated based on a predetermined period after the sensor detects that the drawer changes from the closed state to the open state, or a predetermined period before the sensor detects that the drawer changes from the open state to the closed state.

The signal processor may be operable to detect an accurate weight in a cup comprising a poorly placed note by processing signals from the transducers during the period when the drawer is opening or closing to determine the value of cash in the cups.

The signal processor may be operable to process one or more readings stored as stable readings in the memory during the opening/closing period.

Such periods are ideal for measurement, since the operator will not be interfering with the cups (e.g. putting money in, or taking it out) whilst it is opening/closing.

In practice, it may not be possible to obtain a stable reading every time that the drawer is opened by a user after a transaction. There is a better chance with modern processors, which are able to process more readings in a given time and thereby detect stable readings which otherwise might not have been picked up, but the period when the drawer is opening is still inherently more unstable than when it is closed. However, once a stable reading is obtained, it can replace the incorrect reading, which gives a better result than the prior art, which would either register a wrong reading from an apparently much heavier cup, or register an error and output no result.

The intelligent cash drawer unit or cash register may comprise a timing unit, for example a clock.

The intelligent cash drawer unit or cash register may store the most recent stable open reading and its time, and the most recent stable closed reading and its time.

To achieve this, the signal processor may be operable to continuously process the readings from the transducer(s) and remove transient, i.e. unstable, readings, then save (at least) the most recent stable open reading and its time and (at least) the most recent stable closed reading and its time for each cup into memory.

The signal processor may be operable to store the most recent stable open reading, its time, the most recent stable closed reading and its time into variable fields in memory. The signal processor may be operable to overwrite the data in each field (i.e. open/closed) each time a respective new stable reading is available.

The signal processor may be operable to determine the current time or the time at which the drawer was closed and, where the time of the most recent stable opening is within a certain predefined period of the current time or the time when the drawer was closed, the signal processor may determine that most recent stable open reading corresponds to the correct value of cash in the cup.

Alternatively, or additionally, the signal processor may be operable to determine the current time or the time at which the drawer was closed and, where the time of the most recent stable opening is within a certain predefined period of the current time or the time when the drawer was closed, the signal processor may be operable to compare that most recent stable open reading with the most recent stable closed reading and where they differ by more than a predetermined amount, may be operable to determine that there is a poorly placed note in a cup.

In order to allow the float to be added or the lift to be made, stepwise, whilst the drawer remains open, the intelligent cash drawer may be operable to enter a float and/or lift mode, in response to receiving a signal from for example a button or from an EPOS, e.g. based on an input from a user indicating that a float is to be added, or a lift made. Alternatively, the signal processor may be operable to process signals from the transducers whenever the sensor detects that the drawer is open, and to determine the weight of cash in the cups when open, in order to either (a) detect an accurate weight in a cup comprising poorly placed cash, or (b) allow a float to be added, or a lift to be made, stepwise, whilst the cash drawer remains open. Indeed, if the signal processor is operable to process signals from the transducers whenever the drawer is open, it could also be useful in the event that more than a predetermined (large) number of items of cash are received or dispensed during a sale (e.g. if say a purchaser wished to pay for £300 of goods with five pound notes, these could be introduced stepwise).

The intelligent cash drawer unit or cash register may be operable to store, e.g. in memory, a threshold weight for each of the plurality of cups that is allowed to be added and/or removed in one step.

The threshold weight stored in the memory may be individual to each cup, or possibly the same for all.

The signal processor may be operable to process signals from the transducers in response to a signal from the sensor detecting that the drawer is open, operable to determine the weight of currency in each cup when a stable reading is available, and operable to calculate the weight added to or removed from each cup and compare that to the threshold.

The signal processor may be operable to output a validation signal where the weight added to or removed from each cup is within the threshold, and/or operable to output an error signal where the weight added to or removed from one or more cups is beyond the threshold.

For example, the signals could be outputted to an audio device (which may be within, or outside the intelligent cash drawer unit or cash register) so as to cause an audible alert.

The intelligent cash drawer unit or cash register may comprise an audio device operable to emit a audible alert indicating that (a) a cup comprises poorly placed cash and/or (b) cash may be added or removed as part of cash lift/float procedure.

For example the audio device may be a speaker and the signal processor may be operable to output signals to the audio device so as to cause it to emit different sounds/tones for the validation and error signals.

For example, the signal processor may be operable to output a signal operable to cause the speaker to emit a "beep" as a validation alert in response to the validation signal, and to emit a "burp" as an error alert in response to the error signal.

The signal processor may be operable to store in memory the weight of the cash in each cup after (or before) outputting a validation signal, and/or after (or before) outputting an error signal.

On receiving the validation signal/alert, the user is alerted that he/she has taken out or put in a sufficiently small quantity of cash that the intelligent cash drawer unit or cash register knows the current status of each cup. Accordingly, he/she may then add/remove further notes (again in a sufficiently small quantity).

The intelligent cash drawer unit or cash register may be operable, after outputting a validation signal, to repeat the steps of processing signals from the transducers when the sensor detects that the drawer is open, to determine the weight of currency in each cup when a stable reading is available, to calculate the weight added to or removed from each cup and to compare that to the threshold; and may be operable to continue to output validation and/or error signals based on the comparison with the threshold. In consequence, the accurate stepwise addition of a float or removal of a lift can be conducted without having to close the drawer between additions/removals. When a user is aware of the acceptable number of notes to take from each cup, this can be achieved rapidly.

On receiving the error signal/alert, the user is alerted that he/she has taken out or put in, an excessive quantity of cash and is required to restore the cup or cups from which excessive cash has been taken to their former state (or to return the contents of the entire drawer to its former state). It will be appreciated that a simpler alert (such as the beep/burp set out above) can be used to instruct a user to return the entire drawer to its former state than to instruct a user to restore a particular cup to its former state.

The signal processor may be operable, after outputting the error signal, to continue to process signals from the transducers, to determine the weight of currency in each cup, or in the or each cup which was beyond the threshold, and when a stable reading is available, to compare that to the original weight in the cup or cups, or compare the amount returned to the cup(s) with that which had been added, or the amount taken with that which had been added.

The signal processor may be operable to check that the result of the comparison is within a margin (by comparison with a threshold that is preferably a small percentage of the weight of a note, to account for inaccuracies in the hardware), and, where the comparison is within the margin, to output a validation signal, or where the comparison is outside the margin (indicating that all the money has not been returned to, or taken back from the cups) to output an error signal.

It may be noted that even though the weight of notes may be variable, this comparison is checking that all the same notes are returned/removed from the cups, so the inaccuracy of individual notes does not affect the accurate detection of the weight (since the weight of the same notes will not change in between being returned to the cups or taken back out of the cups).

The intelligent cash drawer unit or cash register may be operable to repeat this process after each error signal.

The processor may be operable to store each stable reading taken when the drawer is open for each cup in memory, and/or to store the most recent stable reading for each cup in memory.

Having completed the lift/float and received a validation signal, the user can close the cash drawer.

The signal processor may be operable to exit float/lift mode in response to the sensor detecting that the drawer is closed. It will then continue to operate as normal.

Indeed, the drawer can be closed prior to receiving a validation signal. The signal processor may be operable to detect based on the output from the sensor that the drawer has been closed prior to outputting a validation signal and operable in that case to process signals from the transducers to determine the weight of cash in each cup when a stable reading is available, to calculate the weight added to or removed from each cup and to compare that to the threshold; the signal processor may then output validation and/or error signals based on the comparison with the threshold.

The signal processor may be operable having calculated that the result of the comparison is outside the threshold, to output an error signal to the user and/or output an error report to an external device, such as a management device.

The signal processor may be operable, in the event that the drawer is closed after issuing a validation signal and storing the most recent stable open reading, to compare the weight of the contents of the cups when the drawer has been closed, with the last stable open reading and where this is outside a margin (again typically a small percentage of the weight of a note, to account for inaccuracies in hardware, not missing notes), the signal processor may be operable to output an error signal to the user and/or output an error report to an external device, such as a management device.

This allows managers to target retraining, or disciplinary procedures (as appropriate, for example depending on whether money has been stolen, or the error signals ignored) towards the cashiers who are failing to use the system properly.

The signal processor may be operable, upon exiting the float/lift mode in response to closure of the drawer to process signals from the transducers to determine the weight of currency in each cup and to transmit the denominational breakdown (i.e. the number of notes in each cup, or the total value for each cup) and optionally additional status information (such as any violation of drawer operating procedures, and/or any poorly placed notes detected to an external system, via a network interface.

If the drawer is shaken (whether deliberately or due to the environment) then stable readings may not be available whilst the drawer is open (and even when closed). This is always the case in count-by-weight technology. In this scenario the drawer will wait until a stable reading is available before issuing a validation message to indicate a known state. If it is taking too long and the user closes the drawer, as set out above, the intelligent cash drawer may be operable to detect that closure and to determine the weight of currency in each cup when a stable reading is available, Ultimately whatever the user does, once the drawer is finally in a stable state (either with the drawer open or shut) the drawer will be able to determine that either—it contains the same weight as before—implying the cashier aborted the cash lift, it contains less weight, but within the limits for accurate counting by weight (here the drawer can accurately report how much cash is missing) or if the weight difference is too great (i.e. the weight missing (i.e. number of notes/coins missing) is so high that the drawer can report the estimated number of missing coins/notes, together with an indication that the count will be in error (usually by +/−one note) more than the threshold percentage of the time.

The invention is also concerned with the detection of poorly placed notes.

Accordingly, in a second aspect of the invention there is provided an intelligent cash drawer unit or cash register having an openable cash drawer comprising a plurality of cups for receiving notes supported on a plurality of transducers operable to weigh the cups, a signal processor operable to process signals received from the transducers to determine the weight of the cash in the cups, and a sensor operable to detect whether the drawer is open or closed; characterised in that the signal processor is operable to detect a poorly placed note, the signal processor being operable to either (a) detect based on the output from the sensor that the drawer is open and process signals from the transducers when the drawer is open, to detect when the drawer is closed based on the output from the sensor and to store a most recent stable open reading and a most recent stable closed reading, to compare those values and where the difference in value is greater than a predetermined value, to determine that a note is poorly placed; or (b) to detect based on the output from the sensor when the drawer is closed, to process signals from the transducers when drawer is closed, and to store stable closed readings and operable to monitor the stable readings, over a predetermined period when the drawer is closed and compare the monitored values and where the apparent weight determined by the transducer appears to reduce by more than a predetermined amount, to determine that a note is poorly placed.

Operation (a) preferably compares a result from when the drawer is closing (as determined by the methods set out above), with a subsequent result when the drawer is closed, or compares a result from when the drawer is opening, with a prior result before the drawer was opened. That way, the amount of cash in the drawer should not have changed, and the difference can be determined to be as a result of a poorly placed note, rather than money being put into, or taken out of, the drawer.

Operation (b) works because it has been observed that (i) where cups contain notes that are poorly placed and sticking up, for the reasons set out above, they give an overly-heavy reading and (ii) it has been observed that over time, when a cash drawer containing such notes is left alone, the notes release some of the strain, which causes the overly-heavy reading, by moving, bending, or otherwise settling, consequently the apparent weight measurement (i.e. the reading from the transducer) reduces over time, whilst the drawer is closed. It should be noted that the overly-heavy reading can be very significant, for example, an incorrect reading caused by a poorly placed note might suggest that as many as 30 extra notes are housed in the cup.

Of course, the second aspect of the invention may be implemented in an intelligent cash drawer unit or cash register according to the first aspect of the invention, including any optional features. Optional features of the first aspect of the invention apply equally to the second aspect, even in the absence of the features of the first aspect, e.g. as with the first aspect, the signal processor of the second aspect of the invention may be operable to continuously process the readings from the transducer(s) and remove transient, i.e. unstable, readings, then save (at least) the most recent stable open reading and its time and (at least) the most recent stable closed reading and its time for each cup into memory.

In either aspect of the invention, the cash drawer may comprise vertical note cups and may detect the presence of a poorly placed note that sticks up from the vertical note cup, or accurately weigh the contents of a cup comprising a poorly placed note that sticks up from the vertical note cup.

A vertical note cup is intended and designed to receive notes with their plane substantially vertical, generally having their long axes substantially horizontal and their short axes substantially vertical. Typically a vertical note cup is taller than it is wide and longer than it is tall. The methods are particularly suited to dealing with poorly placed notes that stick up from vertical note cups, as these are the most likely to push against the top of the cash drawer as set out above.

In either aspect the sensor operable to detect whether the drawer is open or closed may be a micro-switch.

In either aspect, the intelligent cash drawer unit or cash register of the invention may be operable to issue an indicator or alert when a poorly placed note is detected and/or to issue an alert in response to the error signal/validation signals discussed above. The alert or indicator may be issued in various ways.

For example, the signal processor may be operable to send a signal (e.g. via a network interface) to an external device, such as an associated EPOS terminal to provide a visual alert, such as text on a screen.

Alternatively, or additionally, the signal processor may be operable to send a signal to a remote helpdesk terminal, or management terminal so that the indication can be incorporated into a report. In this way, back-office reporting software can track and measure which cashiers are the worst offenders for poorly placing notes in the cups, and managers can take effective action (e.g. targeted retraining).

As another alternative, or addition, as in the first aspect, the intelligent cash drawer may be operable to issue an audible alert.

To this end, in either aspect of the invention, the intelligent cash drawer may comprise an audio device, such as a speaker, a buzzer, a beeper or a bell and the signal processor may be operable to operate the audio device.

The signal processor may be operable to issue the indicator and/or alert when the drawer is closed if a poorly placed note is detected, and/or it may be operable to issue the indicator and/or alert the next time the drawer is opened, to alert the cashier at an opportune moment, when the note can be identified and correctly placed.

As will be appreciated, both of the first two aspects of the invention comprise a signal processor operable to process signals received from the transducers to determine the weight of the cash in the cups, in order to detect poorly placed notes, work out the correct weight when a note is poorly placed, or allow a float to be added, or a lift to be made, stepwise, whilst the drawer remains open. However, it is possible that this calculation could be calculated elsewhere, e.g. on a separate point-of-sale device, another computer/server networked to the intelligent cash drawer or even in "the cloud".

Accordingly, in a third aspect, the present invention provides a method of (a) detecting an accurate weight in a cup comprising a poorly placed note, or (b) allowing a float to be added, or a lift to be made, stepwise, in an intelligent cash drawer unit or cash register having an openable cash drawer comprising a plurality of cups supported on a plurality of transducers, operable to weigh the cups, whilst the drawer remains open; the method comprising detecting whether the drawer is open or closed, receiving and processing signals from the transducers to determine the weight of the cash in the cups; characterised by processing signals from the transducers and determining the weight of cash in the cups when it is detected that the drawer is open.

The method may comprise the step of detecting an accurate weight in a cup comprising a poorly placed note by processing signals from the transducers when the drawer is opening or closing to determine the weight/value of cash in the cups.

The method may comprise the step of determining that the drawer is opening or closing based on the output from the sensor and using measurements from these periods to detect an accurate weight of a cup comprising a poorly placed note.

The method may comprise the step of determining that the drawer is opening or closing by storing stable readings in a buffer in the memory and running back through the buffer to use stable readings from the period just before closure is detected, or just after opening is detected. Alternatively the method may comprise the step of determining based on data from the sensor when the drawer is closed and when it is fully open and using measurements from between these times The method may comprise the steps of detecting stable readings whilst the drawer is open (including opening/closing) and rejecting readings that are determined to be unstable.

The method may comprise the step of storing the most recent stable open reading and its time, and the most recent stable closed reading and its time.

The method may comprise the steps of continuously processing the readings from the transducer(s) and removing transient, i.e. unstable, readings, then saving (at least) the most recent stable open reading and its time and (at least) the most recent stable closed reading and its time for each cup into memory.

The method may comprise the step of storing the data in variable fields in memory, and overwriting the data in each field (i.e. open/closed) each time a respective new stable reading is available.

The method may comprise the step of determining the current time or the time when the drawer was closed and, where the time of the most recent stable opening is within a certain period of the current time or the time when the drawer was closed, using the most recent stable open reading to determine that there is a poorly placed note in a cup, and/or to determine the correct weight of cash in the cup.

The method may determine that there is a poorly placed note in a cup by (where it has been determined that the time of the most recent stable open reading is within a certain period of the current time), comparing the value of the most recent stable open reading and the most recent stable close reading and where the difference in value is greater than a predetermined value, determining that a note is poorly placed.

In order to allow the float to be added or the lift to be made, stepwise, whilst the drawer remains open, the method may comprise the step of receiving a signal indicating that a float and/or lift mode, is to be entered and in response conducting the method set out above.

The method may comprise storing or looking up a threshold weight for each of the plurality of cups (which may be individual to each cup, or possibly the same for all), to be allowed to be added and/or removed in one operation.

The method may comprise processing signals from the transducers when the sensor detects that the drawer is open, determining the weight of currency in each cup, when a stable reading is available, calculating the weight added to or removed from each cup and comparing that to the threshold.

The method may comprise outputting a validation signal where the weight added to or removed from each cup is within the threshold, and/or outputting an error signal where the weight added to or removed from one or more cups is beyond the threshold.

The method may comprise emitting e an audible alert, with different sounds/tones for the validation and error signals, e.g. a "beep" emitted as a validation alert in response to the validation signal, and a "burp" emitted as an error alert in response to the error signal.

The method may comprise storing the weight of the cash in each cup after outputting a validation signal, and/or after outputting an error signal.

On receiving the validation signal/alert, the user is alerted that he/she has taken out or put in a sufficiently small quantity of cash that the intelligent cash drawer unit or cash register knows the current status of each cup. Accordingly, he/she may then add/remove further notes (again in a sufficiently small quantity).

The method may, after outputting a validation signal, repeat the steps of processing signals from the transducers when the sensor detects that the drawer is open, determining the weight of currency in each cup when a stable reading is available, calculating the weight added to or removed from each cup and comparing that to the threshold; and may continue to output validation and/or error signals based on the comparison with the threshold.

The method may, after outputting the error signal, continue to process signals from the transducers, and determine the weight of currency in each cup, or in the or each cup which was beyond the threshold, and when a stable reading is available, compare that to the original weight in the cup or cups, or compare the amount returned to the cup(s) with that which had been added, or the amount taken with that which had been added. The method may comprise the step of then checking that the result of the comparison is within a margin (typically a small percentage of the weight of a note, to account for inaccuracies in the hardware), and, where the comparison is within the margin, outputting a validation signal, or where the comparison is outside the margin (indicating that all the money has not been returned to, or taken back from the cups) outputting an error signal.

The method may comprise the steps of repeating this process after each error signal.

The method may comprise storing each stable reading taken when the drawer is open for each cup, and/or storing the most recent stable reading for each cup.

The method may comprise detecting closure of the drawer and cancelling the float/lift mode in response.

The method may comprise detecting closure of the drawer prior to determining a stable value of weight of cash in the cups and processing signals from the transducers to determine the weight of cash in each cup when a stable reading is available, calculating the weight added to or removed from each cup and comparing that to the threshold; and outputting a validation and/or error signal based on the comparison with the threshold.

The method may comprise determining that the result of the comparison is outside the threshold and outputting an error alert to the user and/or outputting an error report to another device, such as an external management device.

The method may comprise the step of detecting that the drawer has been closed after issuing a validation signal and storing the most recent stable open reading, and then comparing the weight of the contents of the cups when the drawer has been closed, with the last stable open reading and where this is outside a margin (again typically a small percentage of the weight of a note, to account for inaccuracies in hardware, not missing notes), outputting an error signal to the user and/or output an error report to another device, such as an external management device.

The method may comprise the step of detecting that the drawer has been closed, and processing signals from the transducers to determine the weight of currency in each cup and transmitting the denominational breakdown (i.e. the number of notes in each cup, or the total value for each cup), and optionally further status information, such as violations of operating procedures to an external system, or saving the information in a report.

Just as the invention of the first aspect can be carried out outside the intelligent cash drawer unit or cash register, so the invention of the second aspect of detecting poorly placed notes can be carried out outside the intelligent cash drawer unit or cash register.

Accordingly, in a fourth aspect of the invention there is provided a method of determining that a note is poorly placed in a cup of an intelligent cash drawer unit, or cash register, comprising an openable cash drawer comprising a plurality of cups supported on a plurality of transducers, operable to weigh the cups, a signal processor operable to process signals received from the transducers, and a sensor operable to detect whether the drawer is open or closed; the method comprising detecting a poorly placed note, by either (a) detecting that the drawer is open, processing signals from the transducers when the drawer is open, and storing a most recent stable open reading, detecting that the drawer is closed, processing signals from the transducers when the drawer is closed and storing a most stable closed reading, and comparing those values and where the difference in value is greater than a predetermined value, determining that a note is poorly placed; or (b) detecting that the drawer is closed, processing signals from the transducers when the drawer is closed, and storing stable closed readings and monitoring the stable readings, over a predetermined period when the drawer is closed and comparing the monitored values and where the apparent weight determined by the transducer appears to reduce by more than a predetermined amount, determining that a note is poorly placed.

Method (a) preferably compares a result from when the drawer is closing (as determined by the methods set out above), with a subsequent result when the drawer is closed, or compares a result from when the drawer is opening, with a prior result before the drawer was opened. That way, the amount of cash in the drawer should not have changed, and the difference can be determined to be as a result of a poorly placed note, rather than money being put into, or taken out of, the drawer.

Of course, the method of the fourth aspect of the invention may be conducted in addition to the method of the third aspect of the invention and both aspects (and any optional features may be carried out by the apparatus of the first and second aspects. Optional features of the third aspect of the invention apply equally to the fourth aspect, even in the absence of the features of the third aspect, e.g. as with the third aspect, the method of the fourth aspect of the invention may continuously process the readings from the transducer(s) and remove transient, i.e. unstable, readings, then save (at least) the most recent stable open reading and its time and (at least) the most recent stable closed reading and its time for each cup.

In either the third or fourth aspect of the invention, the cash drawer may comprise vertical note cups and the method may detect the presence of a poorly placed note that sticks up from the vertical note cup, or accurately weigh the contents of a cup comprising a poorly placed note that sticks up from the vertical note cup.

In either the third or fourth aspect, the method may comprise issuing an indicator or alert when a poorly placed note is detected and/or issuing an alert in response to the error signal/validation signals discussed above. The alert or indicator may be issued in various ways.

For example, the method may comprise sending a signal (e.g. via a communications bus) to an external device, such as an associated EPOS terminal to provide a visual alert, such as text on a screen.

Alternatively, or additionally, the method may comprise sending a signal to a remote helpdesk terminal, or management terminal so that the indication can be incorporated into a report.

As another alternative, or addition, as in the third aspect, the method may comprise the step of issuing an audible alert.

The audible alert may be issued from an audio signalling device in the cash drawer, such as a speaker, a buzzer, a beeper or a bell.

The method may comprise the step of issuing an indicator or alert when the drawer is closed if a poorly placed note is detected, and/or it may be comprise the step of issuing an indicator or alert the next time the drawer is opened, to alert the cashier at an opportune moment, when the note can be identified and correctly placed.

In any aspect of the invention the intelligent cash drawer unit or cash register may comprise a plurality of note cups and coin cups arranged on respective load cells comprising transducers. For example, the load cells may be strain gauge load cells.

In any aspect of the invention, the intelligent cash drawer unit or cash register may comprise a flip-lid cash drawer unit. Whilst the methods work for both flip-lid or sliding cash drawers, and for cash registers, flip lid cash drawer units are particularly suitable for weighing when open, or whilst opening and most likely to give stable results during these periods.

DETAILED DESCRIPTION OF THE INVENTION

In order that the invention may be more clearly understood an embodiment thereof will now be described, by way of example only, with reference to the accompanying drawings, of which:

Figure 1:
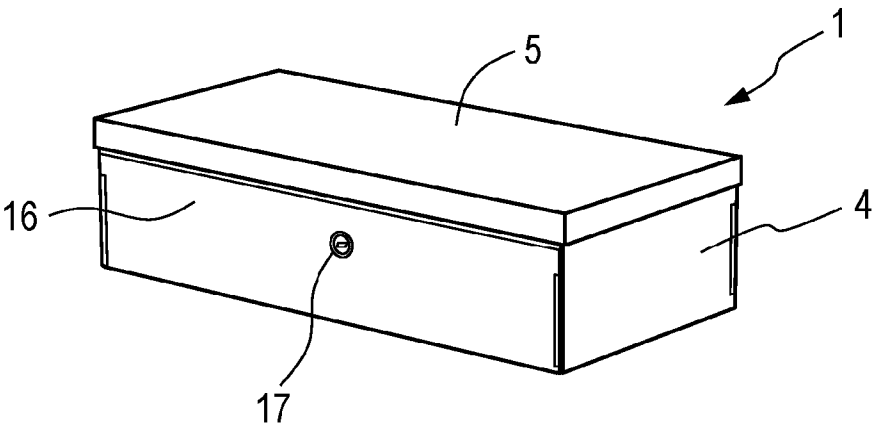
FIG. 1 shows perspective view of an intelligent cash drawer unit according to an embodiment of the invention in the closed state.

With reference to the figures, in particular FIGS. 1-4, an intelligent cash drawer unit 1 is provided with a number of note cups 2*a*, 2*b*, 2*c*, 2*d*, 2*e*, 2*f* (together 2), and coin-cups 3*a*, 3*b*, 3*c*, 3*d*, 3*e*, 3*f*, 3*g*, 3*h* (together 3) arranged within a housing 4. The intelligent cash drawer unit is of the "flip-top" type and comprises a lid 5 hingedly attached to the rear of the housing 4 and arranged to close the top of the housing 4. The intelligent cash drawer unit 1 is intended for use with a separate EPOS (not shown in FIGS. 1-4), but could equally be integrated into a cash register (not shown). Likewise, it could be an intelligent cash drawer unit of the "sliding drawer" type, well known to those skilled in the art.

As is typical, the intelligent cash drawer unit of this embodiment 1 is cuboid, with a long front and shorter sides. The note cups 2 are so-called "vertical" note cups. These vertical note cups 2 are intended and designed to receive notes with their plane substantially vertical, having their long axes horizontal and their short axes vertical. Consequently, the vertical note cups 2 are taller than they are wide and longer than they are tall. The vertical note cups 2 all have their long axes extending parallel to the front and rear of the intelligent cash drawer unit 1 and are arranged in the right hand side of the housing 4, one behind another. They are each intended to receive a specific denomination of note and may be provided with indicia indicating the note they are intended to receive.

The coin cups 3 are intended and designed to receive coins. They are arranged to the left of the note cups 2, in two rows of four, one row behind the other. The coin cups are intended to each receive a specific denomination of coin and may also be provided with indicia showing the denomination they are intended to receive.

The housing 4 and lid 5 of the cash drawer 1 of this embodiment of the invention is in metal, but of course other suitable materials are available (metal has the advantage of shielding components (e.g. load cells, ADC and other circuitry discussed below from electrical noise). The cups 2, 3 in this embodiment are formed from ABS plastic material, e.g. by injection moulding, but of course, other plastics materials, or even other different non-plastics materials could be used.

Figure 4:
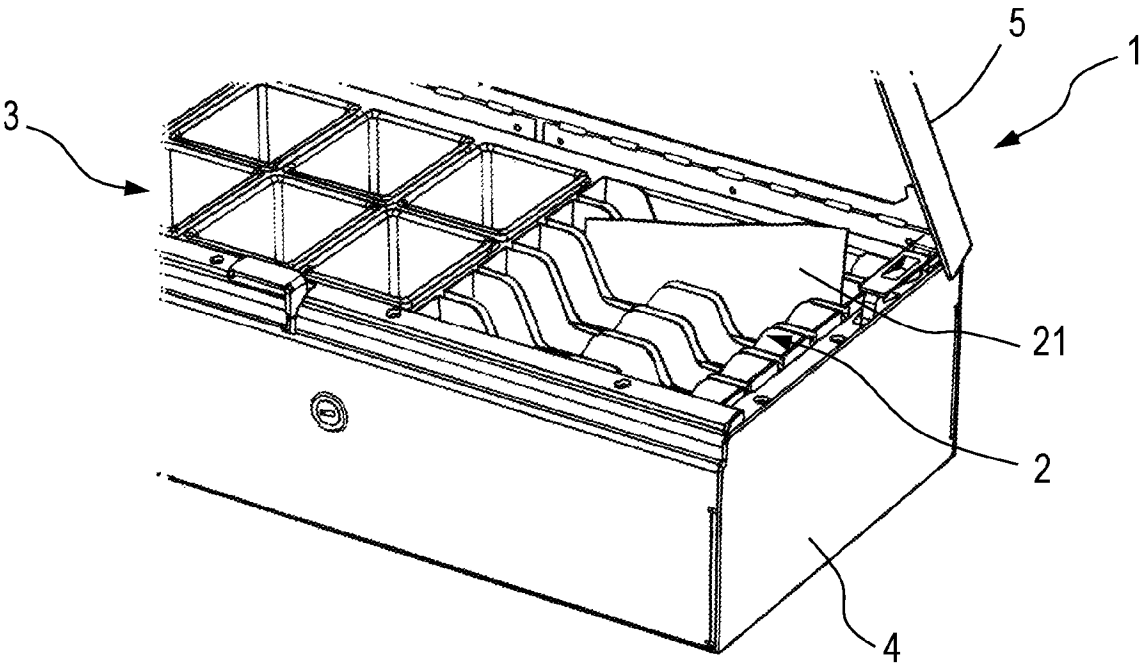
FIG. 4 shows a partial perspective view of the intelligent cash drawer unit of FIGS. 1 to 3 in the open state, with a note poorly placed in one of the note-cups.
Figure 5:
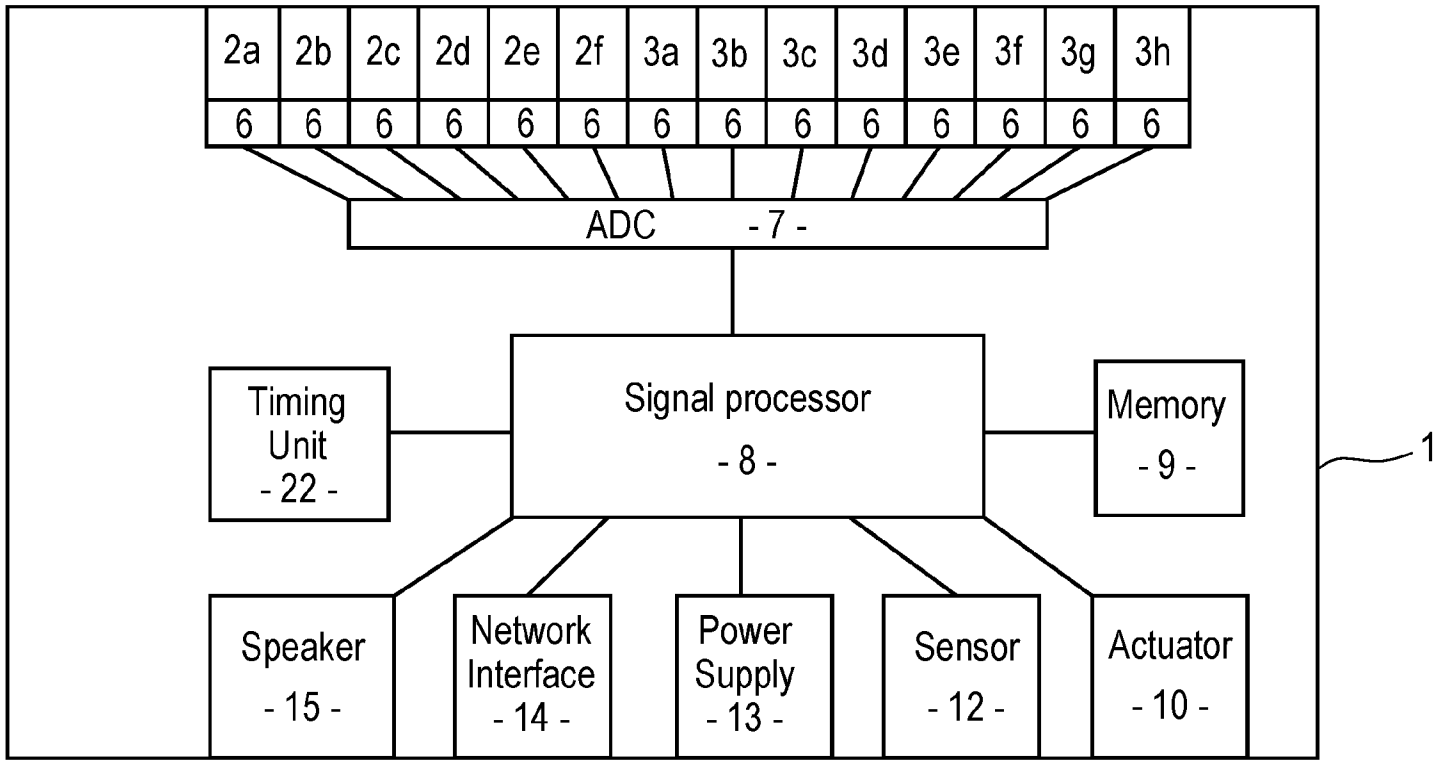
FIG. 5 shows a schematic electrical diagram of the cash drawer of FIGS. 1-4.

As shown schematically in FIG. 5, each cup 2, 3 is supported on a load cell 6 (not visible in FIGS. 1-4), in the form of conventional strain gauge load cells 6 which each comprise a transducer which outputs an analogue electrical signal which varies according to the weight on the load cell 6 to an analogue-digital converter (ADC) 7.

The ADC 7 is connected to a signal processor 8, which in turn is connected to a memory component 9, an actuator 10 (to actuate the latch mechanism 11 shown in FIG. 2 and open the lid 5), a sensor 12 in the form of a micro switch, arranged to detect opening/closing of the lid 5) a power supply 13, a network interface 14, an audio device in the form of a speaker 15, and a timing unit 22, in the form of a clock (which could be integral with the signal processor).

Figure 6:
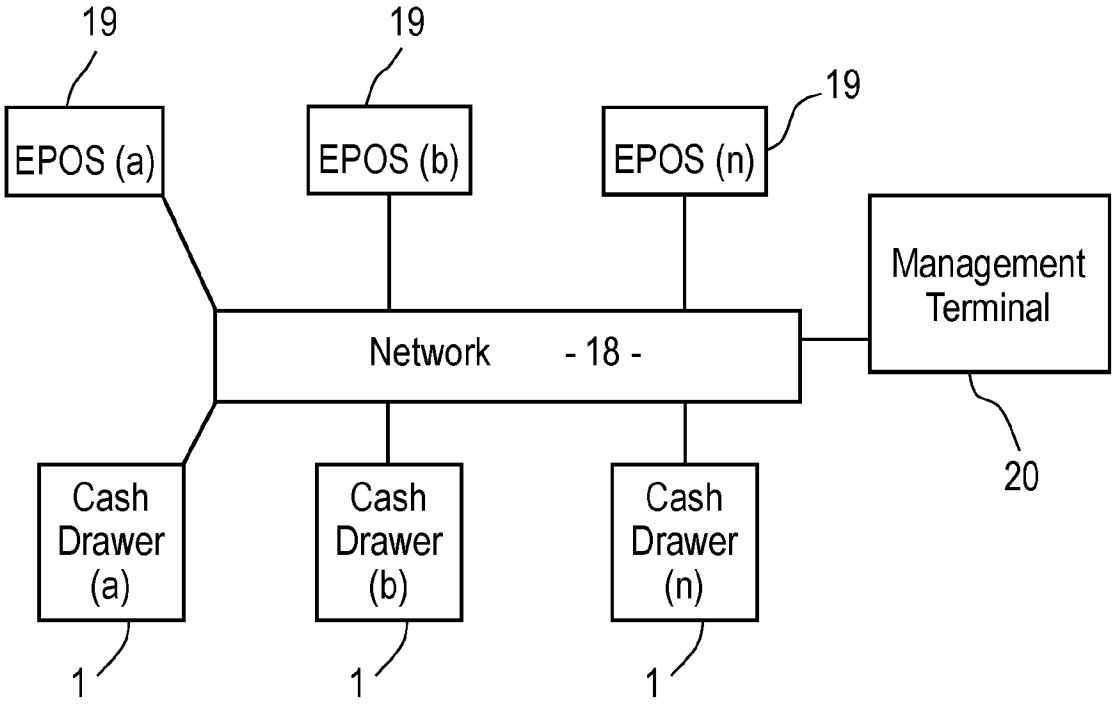
FIG. 6 shows a schematic diagram of a network comprising a plurality of intelligent cash drawer units according to FIGS. 1-5

The network interface 14 is a communications bus and comprises a transceiver to transmit data to and receive data from a network 18, such as a LAN, WAN or internet connection. In this way it can communicate with separate EPOS 19 and/or other networked terminals, such as the management terminal 20 shown schematically in FIG. 6 (which shows a series of intelligent cash drawer units 1 (*a, b, n*) and corresponding EPOS terminals 19 (*a, b, n*).

The micro switch 12 is preferably arranged to be closed by closure of the lid 5, such that it registers opening as soon as the lid 5 starts to open. An alternative embodiment (not shown) also comprises a second micro switch arranged to be closed when the lid is fully open, so as to register full opening, such that the opening/closing period (when the lid is between the closed position and the fully open position) can be accurately detected.

Figure 2:
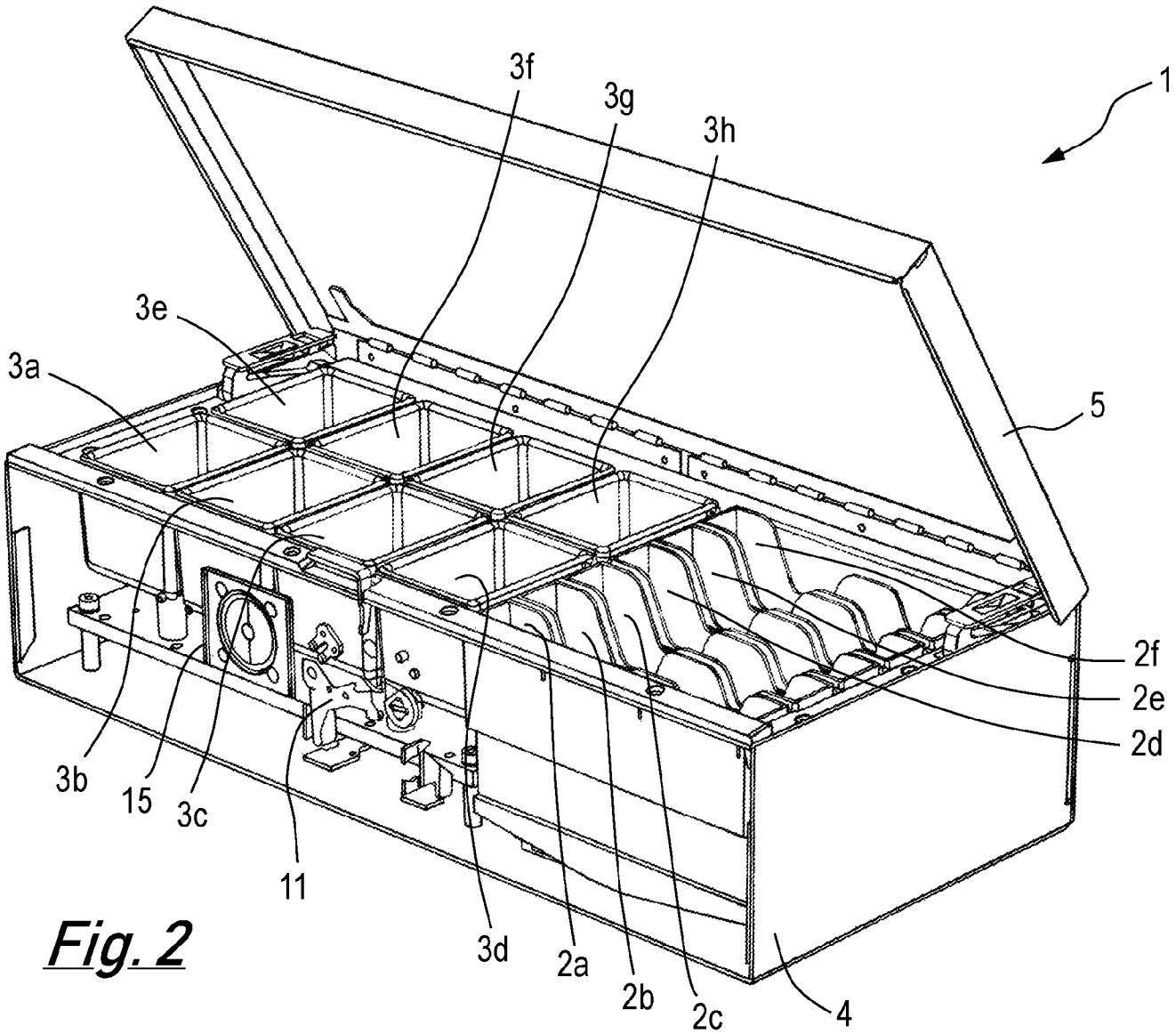
FIG. 2 shows a perspective view of the intelligent cash drawer unit of FIG. 1 part-cutaway.

The actuator 10 may for example be a solenoid arranged to unlatch the latch mechanism 11. The speaker 15, as can be seen by comparing FIGS. 1 and 2 is arranged behind apertures 16 in the front surface of the housing 4. Also visible in FIG. 1 is the keyhole of a lock 17, to manually open the intelligent cash drawer unit 1.

The signal processor 8 controls the operations of the intelligent cash drawer unit 1, based on instructions stored in software in memory 9.

Memory 9, in addition to storing the software on the basis of which the signal processor 8 controls the intelligent cash drawer unit 1, is also operable on instruction from the signal processor 8 to store data, including data from the transducers and data such as the unique serial number of the intelligent cash drawer unit 1, used to identify the intelligent cash drawer unit 1 when reporting to a management terminal (not shown). Memory 9 can comprise non-volatile and volatile memory, with information that should be retained in a power loss stored on non-volatile memory (such as a hard disc, flash memory or battery backed DRAM) and information that need not be kept in the event of loss of power stored on volatile memory. For example, the operating system, and program on the basis of which the signal processor controls the intelligent cash drawer unit 1 should be stored in non-volatile memory.

The current status of the lid 5 (e.g. open/closed), for example, as determined by the sensor 12 may be stored in volatile memory, although advantageously, open/closed status and the time of opening and closing may be stored in non-volatile memory and transmitted via the network interface 14 to the management terminal 20.

According to this embodiment of the invention, the signal processor 8 is operable (in accordance with the operating system stored in memory 9) to process signals from the transducers of the load cells 6 when the sensor 12 detects that the drawer is open (i.e. when it detects that the lid 5 is open), and to determine the weight/value of cash in the cups (2, 3), in order to either (a) detect an accurate weight in a cup 2, 3 comprising a poorly placed note, or (b) allow a float to be added, or a lift to be made, stepwise, whilst the intelligent cash drawer unit 1 remains open.

In terms of detecting poorly placed notes, this embodiment of the invention is primarily concerned with detecting notes 21 misplaced as shown in FIG. 4; that is to say, notes 21 which are not placed fully into the vertical note cups 2, but rather extend (partially) out of the top of the note cup 2, such that when the drawer is closed (by closing the lid 5) they interfere with (pressing against) the top of the cash drawer unit 1, i.e. the lid 5.

As set out in the introduction, this gives rise to inaccurate, overly heavy, weight readings, because the downward force of the lid on the note is transmitted to the respective load cell 6, causing greater strain on the load cell and hence a reading that suggests there are more notes in the respective note cup.

Consequently, to detect the presence of poorly placed notes, the signal processor is operable to process signals from the sensor 12 to determine that the drawer has closed and then process signals from the transducers and store stable closed readings in memory 9. The signal processor 8 is then operable to monitor the stable readings, over a predetermined period when the drawer is closed and compare the monitored values and where the apparent weight determined by the transducer appears to reduce by more than a predetermined amount, to determine that a note is poorly placed.

The predetermined period may for example be one minute or more. The predetermined amount may be the weight of one note of whatever denomination is intended to be inserted into a respective cup 2. This data may be stored in memory 9.

A benefit of this method is that it takes place when the drawer is closed. Consequently, readings from the load cells 6 are unlikely to be affected by outside conditions, e.g.

interaction with the drawer by the cashier, or shaking caused by the drawer opening. Accordingly, it is frequently likely to successfully detect the presence of a poorly placed note.

This embodiment of the invention is also operable to detect a poorly placed note by another method. This second approach is based on the fact that when the intelligent cash drawer unit 1 is open it should (if a settled reading is available) weigh correctly. Thus taking a reading just before the intelligent drawer unit 1 is closed (either by using a buffer to store many settled readings and then running back in the buffer after the drawer is shut to the reading just prior to its closing, or by storing only the most recent stable open reading) and comparing this to the closed reading, it is possible to detect a poorly placed note.

The steps carried out by the signal processor are as follows:

1. Detect whether the lid 5 is open or closed based on the output from the micro-switch 12.

2. Obtain digitized weight values for each cup 2*a-f*, 3*a-h* from the ADC 7, process weight values by transient removal and store the most recent stable weight readings for each cup 2*a-f*, 3*a-h* in two variables in memory 9; MostRecentStableOpenReading and MostRecentStableClosedReading. Obtain the time at which the readings are taken from the timing unit 22 and store the time at which each of these readings were taken in two further variables for each cup 2*a-f*, 3*a-h* in memory 9 as MostRecentStableOpenReading_time and MostRecentStableClosedReading_time 3. Detect closing of the lid 5, and obtain the MostRecentStableOpenReading. Lookup current time from timing unit 22 (timeNow), subtract MostRecentStableOpenReading_time from timeNow and where result is greater than tau (where tau is a parameter stored in memory 9) deem the readings too old and exit without detecting a sticking up note 4 If tau is less than the parameter, subtract MostRecentStableClosedReading from MostRecentStableOpenReading and where the difference is greater than gamma (where gamma is another parameter stored in memory 9) determine that a poorly placed note has been detected. As an example, tau may be a second, or less, to correspond to the period when the intelligent cash drawer unit 1 is being closed and gamma may be the weight of a note of whatever denomination is intended to be stored in a respective cup.

In either method, when a poorly placed note is detected, the signal processor 8 stores in memory 9 the detail of which cup 2*a-f*, 3*a-h* contains the poorly placed note 21 and issues an indicator and an alert.

In particular, the signal processor 8 sends a signal via the network interface, to the associated EPOS terminal 19 to provide a visual alert, such as text on a screen which can indicate the denomination of the cup in which a note has been poorly placed, or simply identify that a note has been poorly placed.

Additionally, a signal is sent to the management terminal 20 so that the indication can be incorporated into a report; the signal may simply be an indication that there is a poorly placed note, or more preferably, the indication will be sent with additional information in the course of reporting. For example, the time of detection of the poorly placed note, the serial number of the intelligent cash drawer unit 1 and if available an indication of the cashier who is logged on, can also be incorporated into the alert. In this way, back-office reporting software can track and measure which cashiers are the worst offenders for poorly placing notes in the cups, and managers can take effective action (e.g. targeted retraining).

In addition, the intelligent cash drawer 1 issues an audible alert, with the signal processor sending a signal to the speaker 15 to cause it to emit an appropriate noise, such as an alert tone or message. The message may indicate the cup 2*a-f* in which the note is poorly placed, although that will normally be obvious to the cashier.

The alert is issued both when the intelligent cash drawer unit 1 is closed (as soon as a poorly placed note is detected), and the next time the lid 5 of the intelligent cash drawer unit 1 is opened, to alert the cashier at an opportune moment, when the note can be identified and correctly placed.

In addition to these two methods of detecting the presence of a poorly placed note, (which could of course be used separately and independently, one without the other, or could be used to cross-check), this embodiment of the invention is arranged to accurately weigh the contents of a note cup 2*a-f* that contains a poorly placed note 21.

This aspect of the invention is based upon the observation that if a settled reading is available when the drawer (i.e. the lid 5) is open then this will be correct even if notes are sticking up because there is nothing for the sticking up notes to interfere with.

As set out above, digitized weight values from the load cells 6 are continuously available and are processed by the signal processor 8 by transient removal, with the most recent stable weight readings stored in two variables—MostRecentStableOpenReading and MostRecentStableClosedReading. The time at which these readings were taken is also stored MostRecentStableOpenReading_time and MostRecentStableClosedReading_time Consequently, if a poorly placed note has been detected by any method then, in response the signal processor 8 is operable to carry out the following steps to determine the correct weight in the cup 2 in which a poorly placed note has been detected:

1. Store the time at which the sensor 12 detected closure of the lid 5 in memory 9 as timeClosed.

2. Test if timeClosed—MostRecentStableOpenReading_time>tau, where tau is a predetermined period corresponding to the likely time taken to close the lid 5. If this is true then the readings are deemed too old to be of use, and the note weights that are used and reported to the EPOS 19 or management terminal 20 in the usual fashion are kept at MostRecentStableClosedReading.

3. If, however, the difference between the time that the drawer was closed and the time of the most recent stable open reading is less than the predefined period of tau, the signal processor 8 declares the note weight in the cup in which the poorly placed note has been detected to be MostRecentStableOpenReading and this value is used for any reporting.

Apart from detecting poorly placed notes and calculating the contents of a cup including such notes, this embodiment of the invention is also arranged to allow a float to be added or the lift to be made, stepwise, whilst the drawer remains open. Of course, those skilled in the art will appreciate that these separate functions need not all be available in the same drawer.

As set out before, real cash, and in particular notes have small variations in their weight, these variations impose an upper limit on how many notes can be reliably counted by a weighing technology, even if the weighing technology was 'perfect'. Given the known statistical variations in the weight of notes compared to their mean weight it is possible to calculate the maximum number of notes that can be counted by weight for a given permissible level of error (for example 0.1% error might be deemed acceptable). This can be a problem in an intelligent cash drawer because users are free to do what they like and may not realise that they are reducing the accuracy of the drawer. In practice users rarely add too many notes in one go, but they might often try to remove a large quantity that has built up over a busy period of trading.

Figure 3:
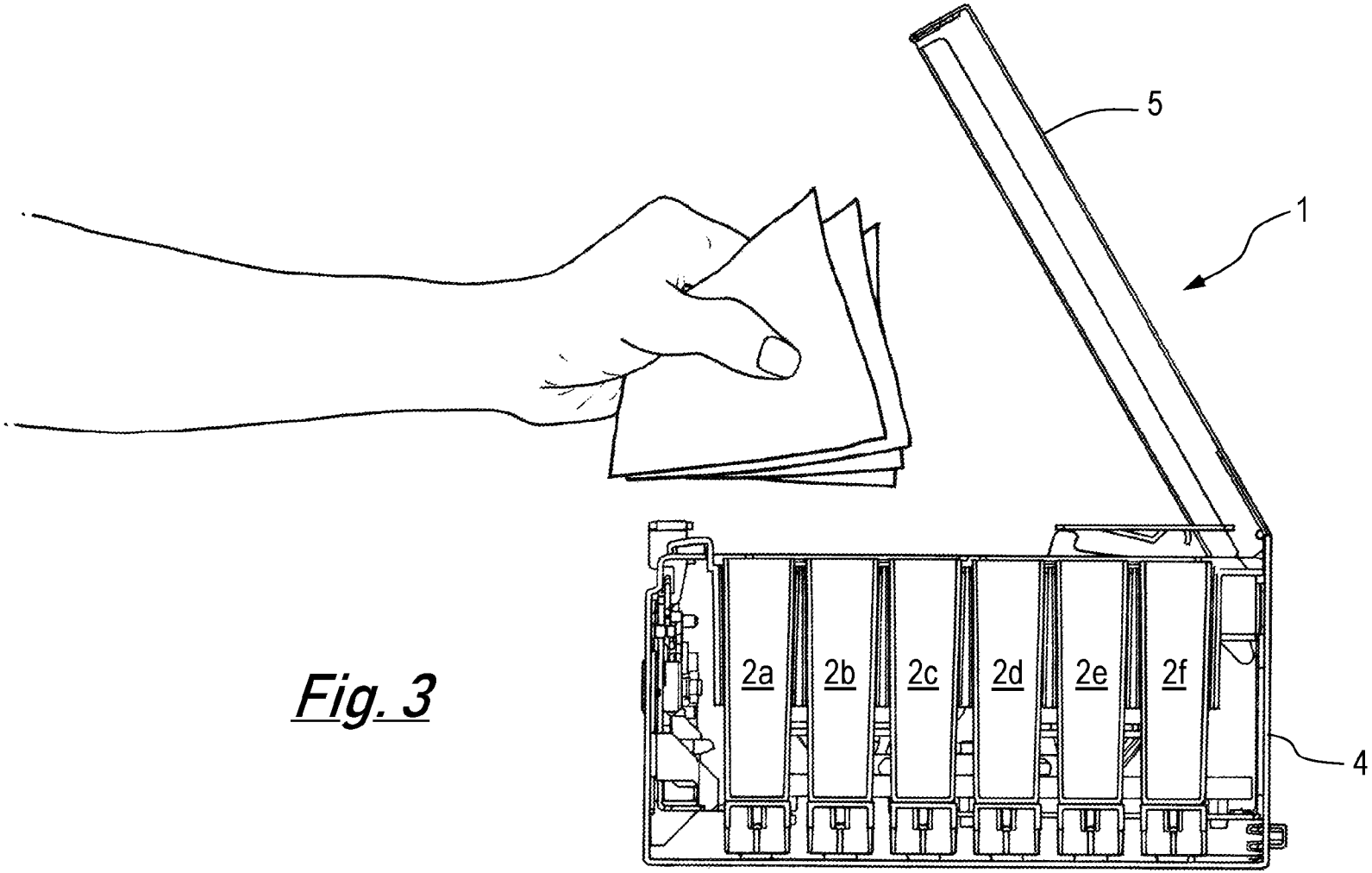
FIG. 3 shows a lateral cross sectional view of the intelligent cash drawer unit of FIGS. 1 and 2 in the open state.

In response to an input, e.g. an open signal from an EPOS, the signal processor 8 sends a signal to the actuator 10 to open the lid, (the lid may, of course, also be opened manually) this allows the user to perform a cash-lift, and remove a bundle of notes as shown in FIG. 3 (and/or coins).

The signal processor 8 then processes signals received from the transducers 6 and detects whether the user has removed so many notes that it is likely to cause an error at a user-defined threshold level. This is done for each cup 2,3 by comparing the weight removed Wr with a predetermined threshold value, alpha, stored in memory 9 for each cup 2,3 and based on the denomination held within each cup 2,3 and the known statistical variations in weight, to a set level defining a number of notes that can be removed with sufficient accuracy. The weight removed Wr can be obtained simply by subtracting (for each cup 2,3) the weight of currency in the cup 2,3 as detected when the readings from the transducers 6 become stable Ws (they will be unstable when the cash is being removed) from the known weight value Wk before the drawer is opened which is stored in memory 9.

Of course the known weight value for each cup before the intelligent cash drawer unit 1 is opened may be substituted with the MostRecentStableOpenValue, if a poorly placed note is present, or indeed the signal processor of the intelligent cash drawer unit 1 may be programmed to refuse to enter the lift/float mode when a poorly placed note has been detected.

Where the comparison of weight removed Wr with the predetermined threshold value alpha, determines that Wr is greater than alpha, the signal processor 8 is operable to store in memory 9 the amount of weight remaining in each cup 2,3 and to send an audible tone to a loudspeaker in the drawer to alert the user that they have removed too many notes. In the embodiment, this error tone is, for example, a long tone (e.g. 2 seconds) at a low frequency, which is likely to be associated in the mind of the cashier with an error (this may be referred to as a "burp"). A signal can also be sent by the signal processor 8 to the associated EPOS 19 to display a visual indication that too many notes/coins have been removed and all the cash must be returned.

On hearing the error tone, the user must replace all the cash that they removed.

Having output the error tone, the signal processor 8 will continue to process digitised signals from the transducers 6 for each cup and compare stable values of the weight Ws with the known weight value Wk from before the drawer was opened. Once the stable weight value Ws for each cup 2,3 is within a predetermined margin beta of the original known weight value from before the drawer was opened, the signal processor unit 8 will determine that all the cash has been returned. The predetermined margin beta may, for example be a fraction of the weight of an item of cash of the denomination intended to be stored in each cup 2,3, for example 10% of the weight of one note/coin. This allows for errors in measuring, but would register if a note was stolen rather than returned. This determination that the notes have been returned is possible because the memory 9 stored the weight before the cash was lifted, so the weight should return to that weight (even if the signal processor 8 cannot be sufficiently confident about the quantity of cash the large batch represented)

Having determined that all the cash has been returned to its original place, the signal processor 8 sends a signal to the audio device 15 to produce a validation tone to signify that the cash has been returned. The validation tone may be a short tone e.g. less than 1 second at a high frequency, e.g. a "beep" which is likely to be associated in the mind of the cashier with an success. A signal can also be sent by the signal processor 8 to the associated EPOS 19 to display a visual indication that the contents of the intelligent cash drawer unit 1 have been restored, and the lift may be attempted once again, taking a smaller batch.

Obviously, if the user does not return all the cash, the drawer not issue a validation signal—so a user cannot exploit this feature to steal a note. However, the signal processor continues to process signals until the comparison of weight Ws with the known weight value Wk from before the drawer was opened for each cup 2,3 is within a predetermined margin beta of the original known weight value from before the drawer was opened. This gives the user flexibility, they may return the cash all at once or in a few batches.

This embodiment does not "time-out" if the cash is not all returned within any predetermined period. Instead, it acts when the intelligent cash drawer unit 1 is finally closed, alerting if the user closes the lid 5 without returning all the cash, by sending a signal to the speaker 15 to emit the error tone.

In order to establish if the user closes the lid 5 without returning all the cash, when the intelligent cash drawer 1 is closed, this is detected by the micro-switch 12, with a corresponding signal being sent to the signal processor 8. The signal processor then to processes digitised signals from the transducers 6 for each cup 2,3 and compares stable values of the weight Ws with the known weight value Wk from before the drawer was opened. The signal processor 8 then divides any weight difference by the weight of one note/coin of the denomination of the cup (or each cup) in which there is a difference in weight to compute the number of missing notes, and transmits any discrepancy via the network interface 14 to reporting software in the associated EPOS 19 and the management terminal 20, so that managers can see that the user has not followed the cash-lift process, by ignoring the warning sound and failing to return the notes. This allows managers to see who the offending cashiers are and perform training. If the discrepancy is so great that the number of notes cannot be accurately determined (i.e. the missing weight is so high that given the known variations in weight, the total number removed cannot be determined accurately), the estimated number can be transmitted together with an indication possible extent of the error (e.g. +/−1 or +/−2 notes) and an indication of the percentage likelihood that there is an error in the count, e.g. 0.1%.

Of course, if the signal processor determines that there is no discrepancy, or the discrepancy is with the margin beta, corresponding to a fraction of the weight of a note, and thus indicating that the inaccuracy is due to hardware, rather than a missing note, it will send a signal to the speaker 15 to emit the validation tone.

Turning back to the situation in which the signal processor has determined that all the cash has been returned to its original place, and sent a signal to the audio device 15 to produce a validation tone to signify that the cash has been returned, once the intelligent cash drawer unit 1 has sounded the tone indicating the original drawer state has been returned then the user may remove a smaller batch of notes/coins.

The signal processor 8 then again processes signals received from the transducers 6 and detects whether the user has removed so many notes/coins that it is likely to cause an error at a user-defined threshold level. This is done for each cup 2,3 by comparing the weight removed Wr with a predetermined threshold value alpha stored in memory 9 for each cup 2,3 and based on the denomination held within each cup 2,3 and the known statistical variations in weight, to a set level defining a number of notes that can be removed with sufficient accuracy. The weight removed Wr is obtained simply by subtracting (for each cup 2,3) the weight of currency in the cup 2,3 as detected when the readings from the transducers 6 become stable Ws from the known weight value Wk before the drawer is opened which is stored in memory 9.

When the stable value of the weight removed Wr is within the threshold value alpha, the signal processor 8 is operable to cause the speaker 13 to issue the validation tone (and optionally send a validation message to the associated EPOS 19) and operable to store to memory 9 the amount of weight removed and/or the amount of weight remaining in each cup 2,3 (knowing the amount previously in each cup, the amount removed, or amount remaining can be calculated easily, provided two of the three values are known).

These steps of processing signals after cash is removed, detecting whether it is within the error threshold (by comparing alpha with the amount of weight removed from the amount remaining in the cup after the last removal step), storing the amount remaining in each cup in memory 9 and issuing a validation signal continues until the user has finished performing the cash-lift.

The user can simply end the process at any time after the drawer makes the validation tone indicating the drawer state is known by simply closing the lid 5.

Upon closing the lid 5, the signal processor is operable transmit via the network interface the status and denominational breakdown to the external reporting system (i.e. the management terminal 20 in this embodiment).

If the intelligent cash drawer unit 1 is shaken (whether deliberately or due to the environment) then stable readings may not be available. This is always the case in count-by-weight technology. This scenario does not alter the behaviour of the intelligent cash drawer, the signal processor 8 continues to process signals from the transducers 6, but waits until a stable reading is available before issuing the signal to emit a validation tone to indicate a known state, or an error tone, if a too-large batch has been removed, or all notes have not been returned having removed a quantity of notes above the threshold value, alpha.

Ultimately whatever the user does, once the drawer is finally in a stable state (either with the drawer open or shut) the drawer will be able to determine that either (a) it contains the same weight as before, implying the cashier aborted the cash lift, (b) it contains less weight, but within the limits for accurate counting by weight—here the drawer can accurately report how much cash is missing, or (c) if the weight difference is too great the drawer can report the estimated number of missing notes, together with an indication that the count will be in error (usually by +/−one note) more than the threshold percentage of the time (e.g. 0.1%).

In accordance with this method, the accurate stepwise removal of a lift can be conducted without having to close the drawer between removal of batches of notes, if/when a user is aware of the acceptable number of notes to take from each cup, this can be achieved rapidly.

Of course, those skilled in the art will immediately see how the method can equally work for addition of a float. However for the sake of completeness it is set out below.

In response to the user opening the cash drawer manually, or in response to an "open" signal from an EPOS which causes the signal processor 8 to send a signal to the actuator 10 to open the lid, the lid is open and the user may perform a cash-float, and introduce a bundle of notes as shown in FIG. 3 (and/or add coins).

The signal processor 8 then processes signals received from the transducers 6 and detects whether the user has added so many notes that it is likely to cause an error at a user-defined threshold level. This is done for each cup 2,3 by comparing the weight added Wa with the predetermined threshold value, alpha, stored in memory 9 for each cup 2,3 and based on the denomination held within each cup 2,3 and the known statistical variations in weight, to a set level defining a number of notes that can be removed with sufficient accuracy. The weight added Wa can be obtained simply by subtracting (for each cup 2,3) the known weight value Wk before the drawer is opened which is stored in memory 9 from the weight of currency in the cup 2,3 as detected when the readings from the transducers 6 become stable Ws (they will be unstable when the cash is being removed).

Again, of course the known weight value for each cup before the intelligent cash drawer unit 1 is opened may be substituted with the MostRecentStableOpenValue, if a poorly placed note is present, or indeed the signal processor of the intelligent cash drawer unit 1 may be programmed to refuse to enter the lift/float mode when a poorly placed note has been detected.

Where the comparison of weight added Wa with the predetermined threshold value alpha, determines that Wa is greater than alpha, the signal processor 8 is operable to store in memory 9 the amount of weight remaining in each cup 2,3 and to send an audible tone to a loudspeaker in the drawer to alert the user that they have added too many notes. In the embodiment, this error tone is, for example, a long tone (e.g. 2 seconds) at a low frequency, which is likely to be associated in the mind of the cashier with an error (this may be referred to as a "burp"). A signal can also be sent by the signal processor 8 to the associated EPOS 19 to display a visual indication that too many notes/coins have been added and all the cash added must be removed.

On hearing the error tone, the user must remove all the cash that they introduced. Typically a float will be added to an empty drawer, so removal should be straightforward.

Having output the error tone, the signal processor 8 will continue to process digitised signals from the transducers 6 for each cup and compare stable values of the weight Ws with the known weight value Wk from before the drawer was opened. Once the stable weight value Ws for each cup 2,3 is within a predetermined margin beta of the original known weight value from before the drawer was opened, the signal processor unit 8 will determine that all the cash has been removed. The predetermined margin beta may, for example be a fraction of the weight of an item of cash of the denomination intended to be stored in each cup 2,3, for example 10% of the weight of one note/coin. This allows for errors in measuring, or dust/detritus in empty cups 2, 3 but would register if an extra note was left in a cup 2, 3.

Having determined that all the cash of the float has been removed, the signal processor 8 sends a signal to the audio device 15 to produce a validation tone to signify that the cash has been returned. The validation tone may again be a short tone e.g. less than 1 second at a high frequency, e.g. a "beep" which is likely to be associated in the mind of the cashier with an success. A signal can also be sent by the signal processor 8 to the associated EPOS 19 to display a visual indication that the contents of the intelligent cash drawer unit 1 have been restored, and the float may be attempted once again, adding smaller batches.

Obviously, if the user does not remove all the cash, the drawer not issue a validation signal.

This embodiment, as with the lift, does not "time-out" if the cash is not all removed within any predetermined period. Instead, it acts when the intelligent cash drawer unit 1 is finally closed, alerting if the user closes the lid 5 without removing all the cash from the float, by sending a signal to the speaker 15 to emit the error tone.

In order to establish if the user closes the lid 5 without removing all the cash from the float, when the intelligent cash drawer 1 is closed, this is detected by the micro-switch 12, with a corresponding signal being sent to the signal processor 8. The signal processor then to processes digitised signals from the transducers 6 for each cup 2,3 and compares stable values of the weight Ws with the known weight value Wk from before the drawer was opened. The signal processor 8 then divides any weight difference by the weight of one note/coin of the denomination of the cup (or each cup) in which there is a difference in weight to compute the number of extra notes, and transmits any discrepancy via the network interface 14 to reporting software in the associated EPOS 19 and the management terminal 20, so that managers can see that the user has not followed the cash-float process, by ignoring the warning sound and failing to remove the notes. This status information allows managers to see who the offending cashiers are and perform training. The discrepancy will normally be so great that the number of notes cannot be accurately determined (i.e. the added weight is so high that given the known variations in weight, the total number added cannot be determined accurately, the estimate number can be transmitted together with an indication possible extent of the error (e.g. +/−1 or +/−2 notes) and an indication of the percentage likelihood that there is an error in the count, e.g. 0.1%.

Turning back to the situation in which the signal processor has determined that all the float has been removed, and sent a signal to the audio device 15 to produce a validation tone to signify that the cash has been removed, once the intelligent cash drawer unit 1 has sounded the tone indicating the original drawer state has been returned then the user may add a smaller batch of notes/coins, just as they should have done in the first place.

Thus, the signal processor 8 then again processes signals received from the transducers 6 and detects whether the user has added so many notes/coins that it is likely to cause an error at a user-defined threshold level. This is done as set out above and when the stable value of the weight added Wa is within the threshold value alpha, the signal processor 8 is operable to cause the speaker 13 to issue the validation tone (and optionally send a validation message to the associated EPOS 19) and operable to store to memory 9 the amount of weight added and/or the amount of weight remaining in each cup 2,3 (knowing the amount previously in each cup, the amount added, or amount remaining can be calculated easily, provided two of the three values are known).

These steps of processing signals after cash is added, detecting whether it is within the error threshold (by comparing alpha with the amount of weight to each cup 2, 3 after the last adding step), storing the amount remaining in each cup in memory 9 and issuing a validation signal continues until the user has finished performing the cash-float.

The user can simply end the process at any time after the drawer makes the validation tone indicating the drawer state is known by simply closing the lid 5.

Upon closing the lid 5, the signal processor is operable transmit via the network interface the status and denominational breakdown to the external reporting system (i.e. the management terminal 20 in this embodiment).

If the intelligent cash drawer unit 1 is shaken (whether deliberately or due to the environment) then stable readings may not be available. This is always the case in count-by-weight technology. This scenario does not alter the behaviour of the intelligent cash drawer, the signal processor 8 continues to process signals from the transducers 6, but waits until a stable reading is available before issuing the signal to emit a validation tone to indicate a known state, or an error tone, if a too-large batch has been added, above the threshold value, alpha.

Ultimately whatever the user does, once the drawer is finally in a stable state (either with the drawer open or shut) the drawer will be able to determine that either (a) it contains the same weight as before, implying the cashier aborted the cash float, or (b) it contains more weight, and if the weight difference is too great the drawer can report the estimated number of added notes, together with an indication that the count will be in error (usually by +/−one note) more than the threshold percentage of the time (e.g. 0.1%).

These steps of determining whether an amount of cash added or removed is within a threshold (alpha) and emitting an error/validation signal accordingly are described above in relation to a cash float or lift. However, those skilled in the art will appreciate that they occur every time the drawer is opened. Consequently, if in the context of a transaction, a number of notes beyond the threshold is added or removed, the signals will prompt the stepwise introduction/removal of the notes (whilst the drawer is open), so as to ensure an accurate count.

As will be appreciated, the above described embodiment of the invention comprises a signal processor 8 operable to process signals received from the transducers 6 to determine the value of the cash in the cups 2,3, in order to detect poorly placed notes, work out the correct weight when a note is poorly placed, or allow a float to be added, or a lift to be made, stepwise, whilst the drawer remains open. However, it is possible that the signal processor could simply output the raw data and this calculation could be calculated elsewhere, e.g. on a separate electronic-point-of-sale device 19, another computer/server such as the management terminal 20 networked to the intelligent cash drawer 1 or even in "the cloud" (not shown).

The above embodiment is described by way of example only. Many variations are possible without departing from the scope of the invention as defined in the appended claims.

The invention claimed is:

1. An intelligent cash drawer unit or cash register having an openable cash drawer comprising a plurality of cups supported on a plurality of transducers operable to weigh the cups, a signal processor operable to process signals received from the transducers to determine a weight of cash in the cups, and a sensor operable to detect whether the cash drawer is open or closed; wherein the signal processor is operable to process signals from the transducers when the sensor detects that the cash drawer is open, and to determine the weight of cash in the cups when the cash drawer is open, in order to detect an accurate weight in a cup comprising poorly placed cash wherein the poorly placed cash is a poorly placed note which sticks up from the cup and touches another part of the intelligent cash drawer unit, so as to allow a lift to be made, stepwise, while the cash drawer remains open.

2. An intelligent cash drawer unit or cash register according to claim 1 comprising a second sensor operable to detect when the cash drawer is fully open, wherein the signal processor is operable to determine when the cash drawer is opening or closing, based on signals from the sensor and the second sensor and operable to detect an accurate weight in a cup comprising a poorly placed note by processing signals from the transducers during a period when the drawer is opening or closing to determine the weight of cash in the cups.

3. An intelligent cash drawer unit or cash register according to claim 1 comprising memory operable to store readings.

4. An intelligent cash drawer unit or cash register according to claim 3 wherein the signal processor is operable to detect stable readings while the drawer is open, to reject readings that are determined to be unstable, and to store stable readings in the memory, wherein the signal processor is operable to determine when the cash drawer is opening or closing, based on signals from the sensor and operable to detect an accurate weight in a cup comprising a poorly placed note by processing one or more readings from the transducers stored as stable readings in the memory during a period when the drawer is opening or closing to determine the weight of cash in the cups.

5. An intelligent cash drawer unit or cash register according to claim 3 comprising a timing unit and wherein the signal processor is operable to store in the memory a most recent stable open reading and its time, and a most recent stable closed reading and its time.

6. An intelligent cash drawer unit or cash register according to claim 5 wherein the signal processor is operable to determine a current time or a time when the cash drawer was closed, to calculate whether the time of the most recent stable open reading is within a certain predefined period of the current time or the time when the cash drawer was closed, and when the time of the most recent stable open reading is within the predefined period, to determine that the most recent stable open reading corresponds to a correct weight of cash in the cup.

7. An intelligent cash drawer unit or cash register according to claim 5 wherein the signal processor is operable to determine a current time or a time when the cash drawer was closed and operable to calculate whether the time of the most recent stable open reading is within a certain predefined period of the current time or the time when the cash drawer was closed, and when the time of the most recent stable open reading is within the predefined period, operable to compare the most recent stable open reading with the most recent stable closed reading and when the most recent stable open reading and the most recent stable closed reading differ by more than a predetermined amount, operable to determine that there is a poorly placed note in a cup.

8. An intelligent cash drawer unit or cash register according to claim 1 which is operable to enter a float and/or lift mode in response to an input from a user indicating that a float is to be added, or the lift is to be made, in order to allow the float to be added or the lift to be made, stepwise, while the drawer remains open.

9. An intelligent cash drawer unit or cash register according to claim 8 comprising a memory, wherein a threshold weight for each of the plurality of cups that is allowed to be added and/or removed in one step is stored in the memory.

10. An intelligent cash drawer unit or cash register according to claim 8 wherein the signal processor is operable to process signals from the transducers in response to a signal from the sensor detecting that the drawer is open, operable to determine a weight of currency in each cup when a stable reading is available, and operable to calculate a weight added to or removed from each cup and compare the weight added to or removed from each cup to a threshold weight for each cup.

11. An intelligent cash drawer unit or cash register according to claim 10 wherein the signal processor is operable to output a validation signal when the weight added to or removed from each cup is within the threshold weight for each cup, and/or operable to output an error signal when the weight added to or removed from one or more cups is beyond the threshold weight for the one or more cups, wherein the signal processor is operable to store in a memory the weight of the cash in each cup after or before outputting the validation signal, and/or after or before outputting the error signal.

12. An intelligent cash drawer unit or cash register having an openable cash drawer comprising a plurality of cups for receiving notes supported on a plurality of transducers operable to weigh the cups, a signal processor operable to process signals received from the transducers to determine a weight of the notes in the cups, and a sensor operable to detect whether the cash drawer is open or closed; wherein the signal processor is operable to detect a poorly placed note, the signal processor being operable to either (a) detect based on an output from the sensor that the drawer is open and process signals from the transducers when the cash drawer is open, to detect when the cash drawer is closed based on the output from the sensor and to store a most recent stable open reading and a most recent stable closed reading, to compare the most recent stable open reading and the most recent stable closed reading and where a difference in value between the most recent stable open reading and the most recent stable closed reading is greater than a predetermined value, to determine that a note is poorly placed; or (b) to detect based on the output from the sensor when the cash drawer is closed, to process signals from the transducers when the cash drawer is closed, and to store stable closed readings and operable to monitor the stable closed readings and determine monitored values of the stable closed readings, over a predetermined period when the cash drawer is closed and compare the monitored values of the stable closed readings and when a difference in value of the monitored values of the stable closed readings reduces by more than a predetermined value, to determine that a note is poorly placed.

13. An intelligent cash drawer unit or cash register according to claim 12 wherein in operation (a), the signal processor compares a result from when the cash drawer is closing, with a subsequent result when the cash drawer is closed, or compares a result from when the cash drawer is opening, with a prior result before the cash drawer was opened.

14. An intelligent cash drawer unit or cash register according to claim 12 wherein the cash drawer comprises vertical note cups.

15. An intelligent cash drawer unit or cash register according to claim 12 operable to detect the presence of a poorly placed note that sticks up from one of the vertical note cups.

16. An intelligent cash drawer unit or cash register according to claim 12 wherein the sensor operable to detect whether the cash drawer is open or closed comprises a micro-switch.

17. An intelligent cash drawer unit or cash register according to claim 12 operable to issue an indicator or alert when a poorly placed note is detected.

18. An intelligent cash drawer unit or cash register according to claim 17 wherein the signal processor is operable to send a signal to an external device, to provide a visual alert, and/or operable to send a signal to a remote helpdesk terminal, or management terminal to enable the indicator to be incorporated into a report and/or an audible alert to be issued.

19. An intelligent cash drawer unit or cash register according to claim 18 comprising an audio device selected from a speaker, a buzzer, a beeper or a bell, wherein the signal processor is operable to operate the audio device, wherein the signal processor is operable to issue the indicator and/or alert when the cash drawer is closed when a poorly placed note is detected, and/or operable to issue the indicator and/or alert a next time the drawer is opened, to alert a user cashier at an opportune moment, when the poorly placed note can be identified and correctly placed.

20. An intelligent cash drawer unit or cash register having an openable cash drawer comprising a plurality of cups supported on a plurality of transducers operable to weigh the cups, a signal processor operable to process signals received from the transducers to determine a weight of cash in the cups, and a sensor operable to detect whether the cash drawer is open or closed; wherein the signal processor is operable to process signals from the transducers when the sensor detects that the cash drawer is open, and to determine the weight of cash in the cups when the cash drawer is open, in order to detect an accurate weight in a cup comprising poorly placed cash wherein the poorly placed cash is a poorly placed note which sticks up from the cup and touches another part of the intelligent cash drawer unit.

21. An intelligent cash drawer unit or cash register according to claim 20 comprising a second sensor operable to detect when the cash drawer is fully open, wherein the signal processor is operable to determine when the cash drawer is opening or closing, based on signals from the sensor and the second sensor and operable to detect an accurate weight in a cup comprising a poorly placed note by processing signals from the transducers during a period when the drawer is opening or closing to determine the weight of cash in the cups.

22. An intelligent cash drawer unit or cash register according to claim 20 comprising memory operable to store readings.

23. An intelligent cash drawer unit or cash register according to claim 22 wherein the signal processor is operable to detect stable readings while the drawer is open, to reject readings that are determined to be unstable, and to store stable readings in the memory, wherein the signal processor is operable to determine when the cash drawer is opening or closing, based on signals from the sensor and operable to detect an accurate weight in a cup comprising a poorly placed note by processing one or more readings from the transducers stored as stable readings in the memory during a period when the drawer is opening or closing to determine the weight of cash in the cups.

24. An intelligent cash drawer unit or cash register according to claim 22 comprising a timing unit and wherein the signal processor is operable to store in the memory a most recent stable open reading and its time, and a most recent stable closed reading and its time.

25. An intelligent cash drawer unit or cash register according to claim 24 wherein the signal processor is operable to determine a current time or a time when the cash drawer was closed, to calculate whether the time of the most recent stable open reading is within a certain predefined period of the current time or the time when the cash drawer was closed, and when the time of the most recent stable open reading is within the predefined period, to determine that the most recent stable open reading corresponds to a correct weight of cash in the cup.

26. An intelligent cash drawer unit or cash register according to claim 24 wherein the signal processor is operable to determine a current time or a time when the cash drawer was closed and operable to calculate whether the time of the most recent stable open reading is within a certain predefined period of the current time or the time when the cash drawer was closed, and when the time of the most recent stable open reading is within the predefined period, operable to compare the most recent stable open reading with the most recent stable closed reading and when the most recent stable open reading and the most recent stable closed reading differ by more than a predetermined amount, operable to determine that there is a poorly placed note in a cup.

27. An intelligent cash drawer unit or cash register according to claim 20 which is operable to enter a float and/or lift mode in response to an input from a user indicating that a float is to be added, or the lift is to be made, in order to allow the float to be added or the lift to be made, stepwise, while the drawer remains open.

28. An intelligent cash drawer unit or cash register according to claim 27 comprising a memory, wherein a threshold weight for each of the plurality of cups that is allowed to be added and/or removed in one step is stored in the memory.

29. An intelligent cash drawer unit or cash register according to claim 27 wherein the signal processor is operable to process signals from the transducers in response to a signal from the sensor detecting that the drawer is open, operable to determine a weight of currency in each cup when a stable reading is available, and operable to calculate a weight added to or removed from each cup and compare the weight added to or removed from each cup to a threshold weight for each cup.

30. An intelligent cash drawer unit or cash register according to claim 29 wherein the signal processor is operable to output a validation signal when the weight added to or removed from each cup is within the threshold weight for each cup, and/or operable to output an error signal when the weight added to or removed from one or more cups is beyond the threshold weight for the one or more cups, wherein the signal processor is operable to store in a memory the weight of the cash in each cup after or before outputting the validation signal, and/or after or before outputting the error signal.

* * * * *